United States Patent [19]

Loicq

[11] Patent Number: 4,720,944

[45] Date of Patent: Jan. 26, 1988

[54] SUSPENDED CEILING PANEL RETAINING SYSTEM

[76] Inventor: Paul Loicq, 12 Rue des Fonds Verts, Eragny Sur Oise (Val de Marne), France

[21] Appl. No.: 8,291

[22] Filed: Jan. 29, 1987

Related U.S. Application Data

[63] Continuation of Ser. No. 870,616, Jun. 4, 1986, abandoned, which is a continuation-in-part of Ser. No. 755,617, Jul. 16, 1985, abandoned.

[51] Int. Cl.[4] ..... E04B 5/57

[52] U.S. Cl. ..... 52/1; 52/484; 52/573; 52/735

[58] Field of Search ..... 52/484, 1, 573, 144, 52/735; 428/402, 460

[56] References Cited

U.S. PATENT DOCUMENTS

| | | | |
|---|---|---|---|
| 1,826,133 | 10/1931 | Hatch | 52/772 |
| 2,286,976 | 6/1942 | Roberts | 52/746 |
| 3,174,851 | 3/1965 | Buehler et al. | 148/11.5 F |
| 3,351,463 | 11/1967 | Rozner et al. | 148/426 |
| 3,753,700 | 8/1973 | Harrison et al. | 148/402 |
| 4,149,911 | 4/1979 | Clabburn | 428/960 |

FOREIGN PATENT DOCUMENTS

| | | | |
|---|---|---|---|
| 545483 | 5/1942 | United Kingdom | 52/772 |
| 588498 | 4/1946 | United Kingdom | 52/489 |
| 799683 | 8/1958 | United Kingdom | 52/489 |
| 1327441 | 8/1973 | United Kingdom . | |
| 1327442 | 8/1973 | United Kingdom . | |
| 2161845 | 1/1986 | United Kingdom | 52/484 |

OTHER PUBLICATIONS

Scripta Metallurgica, vol. 4, pp. 469 thru 472, dated Mar. 8, 1870.

Science, Jun. 1981, pp. 44 thru 47.

*Primary Examiner*—James L. Ridgill, Jr.

*Attorney, Agent, or Firm*—Louis Orenbuch; Paul Kudirka

[57] ABSTRACT

An improved suspended ceiling of the type having ceiling panels resting on a support framework employs shape-memorizing metal alloy members to hold the panel in place on the framework in the event of fire and causing the panels to rest freely on the framework at normal temperatures to enable the panels to be easily removed or pushed up for access to the space above the panels. At a critical temperature, the memory members revert to their memorized shape and in so doing cause retention members to move and extend over the panels to hold those panels in place.

2 Claims, 4 Drawing Figures

SUSPENDED CEILING PANEL RETAINING SYSTEM

This application is a continuation of my earlier application Ser. No. 870,616 which is now abandoned was filed in the U.S. Patent and Trademark Office on June 4, 1986. That earlier application is a continuation-in-part of my parent patent application Ser. No. 755,617 which was filed in the U.S. Patent and Trademark Office on July 16, 1985 and is now abandoned.

This invention relates in general to ceilings of the type having panels suspended on a support framework. More particularly, the invention pertains to suspended ceilings which can provide a measure of fire protection for the building or structure in which it is situated.

French regulation article CO11, Fire Safety Rule No. 1477-1 provides that

"Suspended ceilings cannot be taken into consideration in calculating the fire resistance of their associated floors when—the panels can be removed by simple thrust or pressure"

In conventional suspended ceilings that are used for fire protection, the panels are held in place by spring clips that clamp the panels to the framework. When the conventional suspended ceiling is not used for fire protection, the panels rest by gravity upon the support framework to enable those panels to be easily removed or pushed up to give access to the space above where air conditioning ducts, electrical cables, conduits, etc., are usually placed for concealment by the suspended ceiling.

The invention here disclosed not only provides fire protection by securing the panels to the framework in the event of a fire but also enables the ceiling panels to freely rest on the framework at normal temperatures so that the panels can be easily removed or pushed up. For example, the invention can be made to secure the panels to the framework when the temperature reaches 70° C.—anything below that critical value being deemed to not present a fire hazard.

The invention employs shape-memorizing metal members that are made, for example, of nickel-titanium alloy. Those memory members are secured to the conventional ⊥-section supports that comprise the framework of conventional suspended ceilings. The memory metal members are arranged to cause projections to extend over the panels when the temperature reaches the critical value. Those projections then hold the panels in place on the framework and prevent the panels from moving upward. Below the critical temperature, the memory members cause the projections to be held in positions where they do not interfere with the lifting of the panels. When the temperature of the framework reaches the critical level, the metal members revert to the form memorized during the preparation of the alloy, that reversion being the result of a change in crystalline structure due to a reversible transformation in the metal between an austenitic state and a martensitic state.

As is known, certain alloys, commonly termed "memory alloys", have been used to make articles that revert to their memorized shapes when sufficiently heated. Those articles are deformed from their original shapes and retain their deformity until heated to the reversion temperature at which they recover their original shape. These memory alloys exhibit a transformation from a low temperature martensitic form to a high temperature austenitic form and it is this transformation which produces the memory effect. Among such substances are alloys of titanium and nickel which are described, for example, in U.S. Pat. Nos. 3,174,851, 3,351,463, 3,753,700, British Pat. Nos. 1,327,441, and 1,327,442 and NASA Publication SP 110, titled "55-Nitinol The Alloy with a Memory, etc." (U.S. Government Printing Office, Washington, D.C. 1972). The property of memorizing a shape is not, however, solely confined to such titanium-nickel alloys. Various beta-brass alloys, for example, have been found to exhibit this property. Those beta-brass alloys are discussed by N. Nakanishi et al in Scripta Metallurgica, Vol. 5, pp 433–440, 1971. Similarly, 304 stainless steels have been found to have such memory characteristics, as disclosed by E. Enami et al., id, at pp. 663–68.

As mentioned above, those alloys exhibit a shape retaining memory on passing from a low temperature martensitic form to a high temperature austenitic, form. In accordance with the invention, the memory alloys cause the panels to be held in position on the support framework by projections that move to extend over the panels when the temperature reaches the value at which the martensite converts to austenite.

The alloys used in the invention can have many different memorized shapes. In one embodiment of the invention, the panel retention members are entirely made of a memory alloy which is distorted from its memorized L-shape to form a flat plate that is secured to the web of the framework ⊥-section by rivets or other means so that at normal temperatures the plate is flat against the web. When the temperature rises to the critical value, the alloy returns to its memorized L-shape with one leg of the L extending over the panel of the suspended ceiling.

In another embodiment of the invention, the memory alloy is in the form of a pin that is held in a slot in the web of the ⊥-section support framework. The pin carries a leaf and the pin is deformed by twisting it to cause the leaf to be housed in the slot when the temperature is below the critical value. Upon the temperature reaching the critical value, the pin untwists and causes the leaf to swing and project over the ceiling panel.

Figure 1:
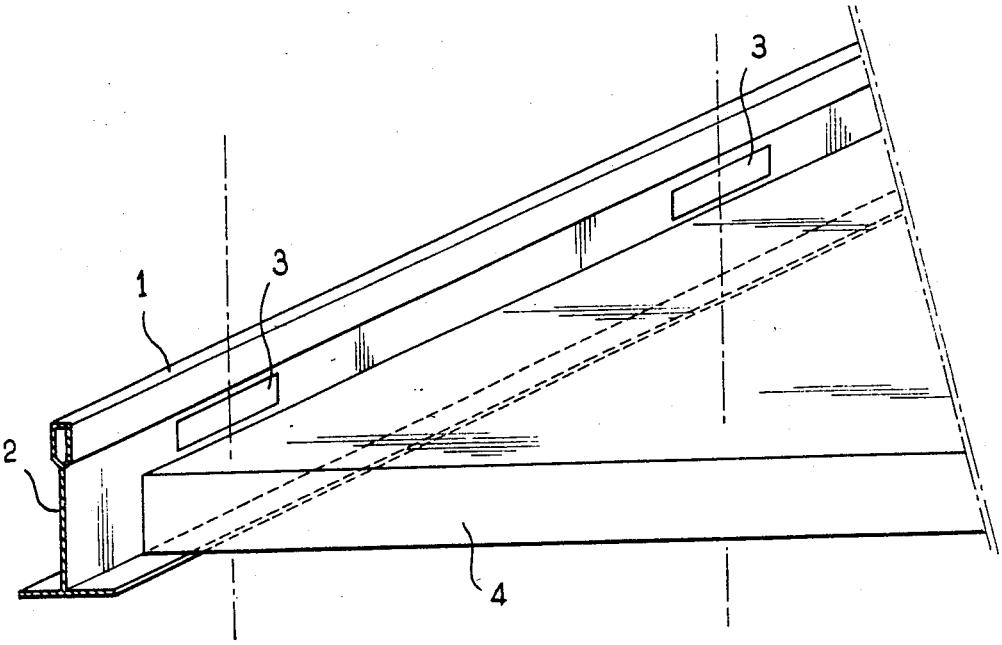
FIG. 1 shows the preferred embodiment of the invention in which the memory alloy panel retaining member is a flat plate that lies against the web of the ⊥-section of the framework.
Figure 2:
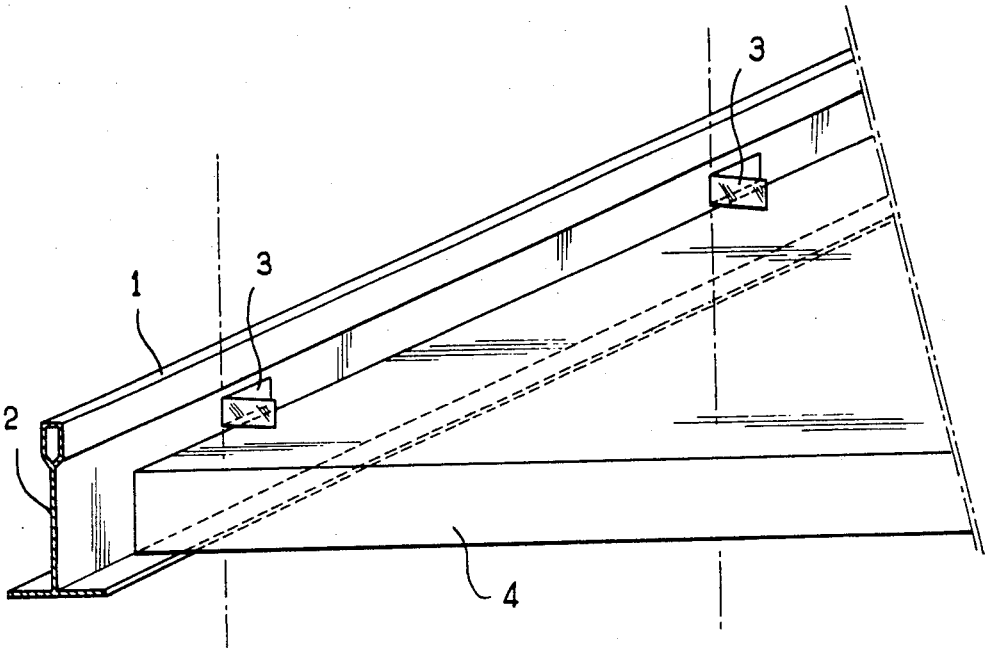
FIG. 2 shows the L-form of the panel retaining memory alloy member of FIG. 1 after the temperature has reached the critical value.

Referring now to FIGS. 1 and 2, there is shown a ceiling panel 4 suspended on the base of the ⊥-section 2 of the support framework. Panel retaining members 3 made of a memory alloy are, in FIG. 1, in the distorted form of flat plates. As shown in FIG. 2, those flat plates change to the memorized L-shape depicted in FIG. 2 when the temperature reaches the critical value. One leg of the L-member extends, as shown, over the panel 4. The other leg of the L-member is attached to the web 2 of the ⊥-section by rivets or by other means. When the memory members 3 are in the L-form, the panel is held in place on the support framework and cannot be lifted up. Below the critical temperature, the memory member is flat against web 2 where it does not interfere with lifting of the panel.

Figure 3:
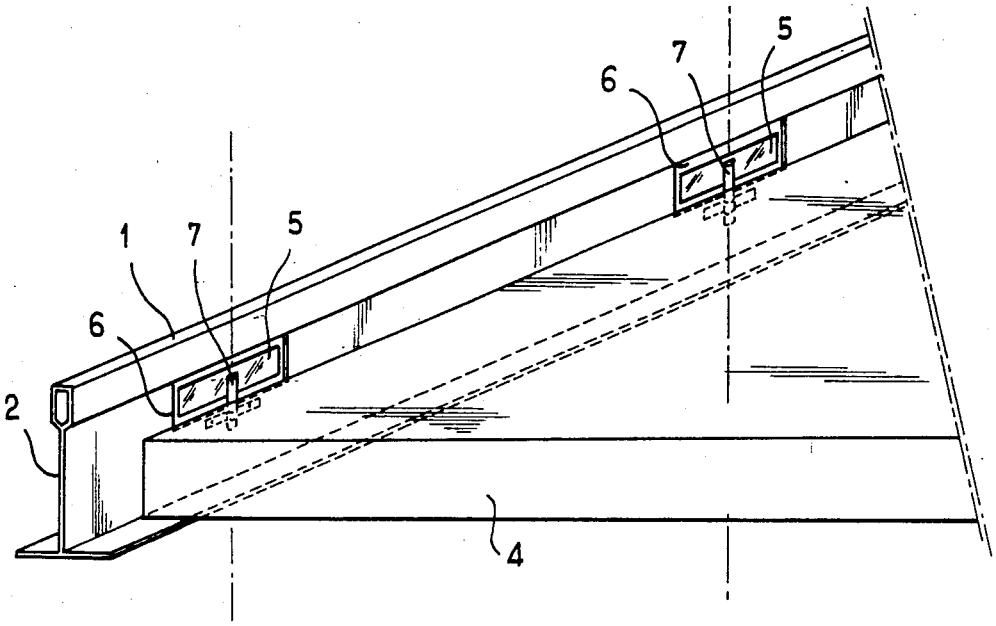
FIG. 3 depicts an alternative embodiment of the invention employing a twisted memory alloy pin carrying a panel retaining leaf.
Figure 4:
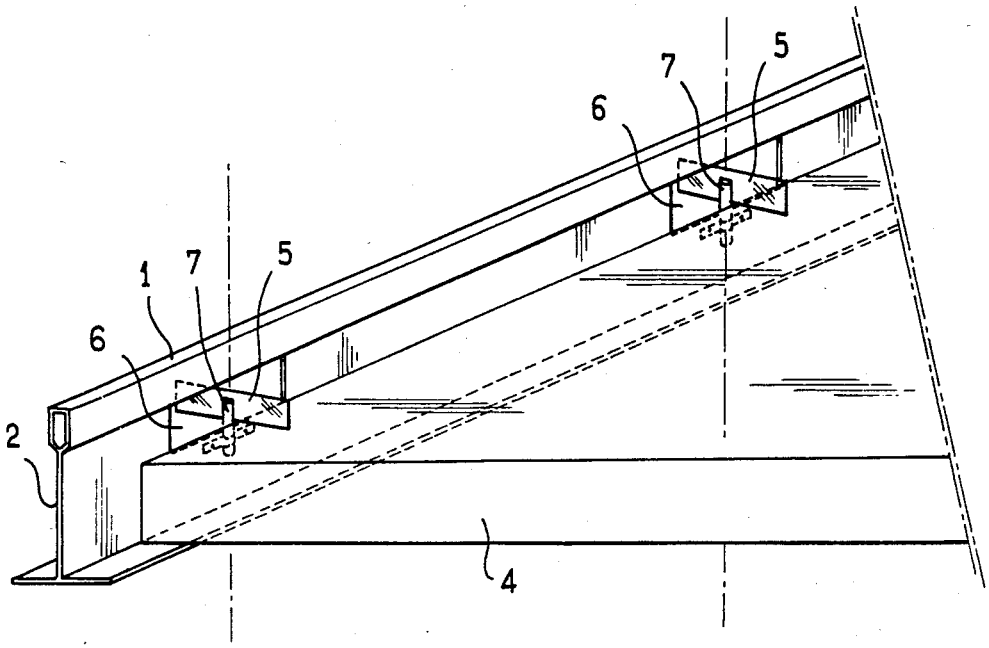
FIG. 4 shows the position of the panel retaining leaf of the FIG. 3 embodiment after the temperature has reached the critical value of the memory alloy pin.

FIGS. 3 and 4 depict another embodiment of the invention. In this embodiment memory alloy pins 7 are attached to the web 2 of the support framework ⊥-sections. Each pin 7 is deformed by twisting it and the twisted pin and carries a leaf 5, which at normal temperatures, is situated as shown in FIG. 3, in a slot 6 in the web 2 of the support framework where the leaf does not interfere with the lifting of the ceiling panel 4.

When the temperature reaches the critical value, the martensitic pins convert to austenite and thereupon rotate to assume their untwisted memorized shape. In the untwisted memorized shape, the leafs 5 are turned so that they extend over the suspended ceiling panel 4 and prevent lifting of the panel.

What is claimed is:

1. A panel retaining suspended ceiling comprising (a) a framework of support sections having upstanding webs and flanges extending laterally from the webs, the laterally extending flanges providing support ledges, (b) ceiling panels suspended on the framework, the ceiling panels extending between the webs of the support sections and resting upon the ledges, and (c) memory metal alloy flat plate members having memorized L-shapes, the flat plate members being attached to the webs of the support sections for holding the panels in place on the framework in the event of a rise in temperature to a critical value, the memory metal alloy flat plate members having at least the legs of the L-shapes disposed at a level higher than the ceiling panels resting on the ledges, and the memory metal alloy flat plate members reverting to their memorized L-shapes upon the temperature reaching the critical value whereby the legs of those members extend over the panels and hold the panels in place on the framework.

2. A panel retaining suspended ceiling comprising (a) a framework of support sections having upstanding webs with apertures therein and having flanges extending laterally from the webs, the flanges providing support ledges, (b) ceiling panels suspended on the framework, the ceiling panels extending between the webs of the support sections and resting upon the ledges, and (c) memory metal alloy pins having a memorized untwisted state, the pins being attached to the webs in the vicinity of said apertures in the webs, the memory metal alloy pins carrying flat leaves disposed in said apertures in alignment with the webs, the flat leaves being at a higher level than the ceiling panels resting on the ledges of the support sections, and the memory metal alloy pins being adapted to revert to their memorized untwisted state upon the temperature reaching a critical value whereby the flat leaves are turned upon untwisting of the pins and extend over the panels to thereby hold the panels in place on the framework.

* * * * *